US010885737B2

(12) United States Patent
Fong et al.

(10) Patent No.: US 10,885,737 B2
(45) Date of Patent: Jan. 5, 2021

(54) METHOD OF GAMING, A GAMING SYSTEM AND A GAME CONTROLLER

(71) Applicant: ARISTOCRAT TECHNOLOGIES AUSTRALIA PTY LIMITED, North Ryde (AU)

(72) Inventors: Colin Fong, Penshurst (AU); Matthew Chan, East Killara (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 2 days.

(21) Appl. No.: 16/210,695

(22) Filed: Dec. 5, 2018

(65) Prior Publication Data

US 2019/0108720 A1 Apr. 11, 2019

Related U.S. Application Data

(63) Continuation of application No. 15/232,488, filed on Aug. 9, 2016, now Pat. No. 10,176,664.

(30) Foreign Application Priority Data

Aug. 10, 2015 (AU) ..... 2015903199

(51) Int. Cl.
*G07F 17/32* (2006.01)
*G07F 17/34* (2006.01)

(52) U.S. Cl.
CPC ..... *G07F 17/3213* (2013.01); *G07F 17/3206* (2013.01); *G07F 17/3209* (2013.01); *G07F 17/3225* (2013.01); *G07F 17/3246* (2013.01); *G07F 17/3251* (2013.01); *G07F 17/34* (2013.01)

(58) Field of Classification Search
CPC ..... G07F 17/3213; G07F 17/3255; G07F 17/326; G07F 17/34
See application file for complete search history.

(56) References Cited

U.S. PATENT DOCUMENTS

| | | | | |
|---|---|---|---|---|
| 7,108,602 | B2 | 9/2006 | Daly | |
| 7,252,591 | B2 | 8/2007 | Van Asdale | |
| 8,096,877 | B2 | 1/2012 | Hoffman | |
| 8,574,059 | B2 | 11/2013 | Rodgers et al. | |
| 8,986,102 | B2 | 3/2015 | Vandaele | |
| 9,836,916 | B2 * | 12/2017 | Koza | G07F 17/322 |
| 10,229,562 | B2 * | 3/2019 | Saunders | G07F 17/34 |
| 10,311,667 | B2 * | 6/2019 | Loyed | G07F 17/3211 |
| 2001/0055989 | A1 | 12/2001 | Thomas | |

(Continued)

*Primary Examiner* — Steven J Hylinski
(74) *Attorney, Agent, or Firm* — Armstrong Teasdale LLP

(57) ABSTRACT

Method and systems of gaming are provided herein. One method includes storing in a memory of the gaming system a plurality of reel strips sets, each reel strips set including a characteristic that is different from the other reel strips sets. The method may further include initiating a play of the game. The method may include selecting, at random, via the game controller, a reel strips set from the plurality of reel strips sets. The method also includes displaying, via the game controller, symbols in symbol display positions on the display of the gaming system. The method further includes evaluating, via the game controller, the selected symbols. The method further includes updating, via the game controller, a meter stored in the memory in accordance with the evaluation.

20 Claims, 10 Drawing Sheets

(56) References Cited

U.S. PATENT DOCUMENTS

2002/0025846 A1* 2/2002 Bennett ..... G07F 17/3244 463/20
2005/0009597 A1 1/2005 Daly
2005/0164777 A1 7/2005 Daly
2006/0287036 A1 12/2006 Daly et al.
2007/0060252 A1* 3/2007 Taylor ..... G07F 17/32 463/16
2007/0105611 A1 5/2007 O'Halloran
2008/0064487 A1 3/2008 Stevens et al.
2008/0102923 A1 5/2008 Daley
2008/0102928 A1 5/2008 Daley
2008/0220839 A1 9/2008 DeBrabander et al.
2009/0124347 A1 5/2009 Rodgers et al.
2009/0197667 A1 8/2009 Kim
2009/0298573 A1* 12/2009 Bramble ..... G07F 17/32 463/20
2010/0016061 A1 1/2010 Gomez et al.
2010/0234092 A1 9/2010 Gomez et al.
2011/0151961 A1 6/2011 Stevens et al.
2011/0263312 A1 10/2011 De Waal et al.
2012/0083327 A1 4/2012 Zobel et al.
2013/0079101 A1 3/2013 Nicely
2013/0150142 A1 6/2013 Caputo
2013/0260863 A1 10/2013 Lee et al.
2013/0273997 A1 10/2013 Stewart
2014/0057698 A1 2/2014 Rodgers et al.
2014/0066174 A1 3/2014 Rodgers et al.
2014/0087822 A1 3/2014 Watkins
2014/0087832 A1 3/2014 Zoltewicz et al.
2014/0135096 A1 5/2014 Aida et al.
2014/0179402 A1 6/2014 Delekta
2014/0248936 A1 9/2014 Basallo et al.
2014/0274294 A1 9/2014 Baerlocher et al.
2014/0370964 A1 12/2014 Basallo et al.
2015/0080100 A1 3/2015 Lee et al.
2015/0105136 A1* 4/2015 Delekta ..... G07F 17/3213 463/20
2015/0105137 A1* 4/2015 Delekta ..... G07F 17/3213 463/20
2015/0105138 A1 4/2015 Delekta et al.
2016/0005260 A1* 1/2016 Miyagawa ..... G07F 17/3267 463/31
2016/0110943 A1* 4/2016 Nicely ..... G07F 17/3269 463/20

* cited by examiner

801

REEL SET A

| R1 | R2 | R3 | R4 | R5 |
|---|---|---|---|---|
| A | 9 | J | 10 | 9 |
| Q | K | A | K | 10 |
| PIC1 | SCAT | SCAT | WILD | PIC2 |
| 10 | Q | 10 | J | A |
| A | A | 9 | K | Q |
| PIC4 | PIC2 | PIC3 | PIC4 | PIC4 |
| Q | 9 | Q | Q | 10 |
| K | J | J | 10 | K |
| PIC3 | PIC4 | SCAT | PIC3 | PIC1 |
| 9 | 10 | K | 9 | J |
| PIC1 | PIC1 | PIC1 | PIC1 | PIC1 |
| PIC1 | PIC1 | PIC1 | PIC1 | PIC1 |
| PIC1 | PIC1 | PIC1 | PIC1 | PIC1 |
| PIC1 | PIC1 | PIC1 | PIC1 | PIC1 |
| PIC1 | PIC1 | PIC1 | PIC1 | PIC1 |
| PIC1 | PIC1 | PIC1 | PIC1 | PIC1 |
| PIC1 | PIC1 | PIC1 | PIC1 | PIC1 |
| PIC1 | PIC1 | PIC1 | PIC1 | PIC1 |
| 10 | PIC1 | PIC1 | 9 | PIC1 |
| PIC4 | Q | J | PIC4 | 10 |
| J | PIC3 | PIC4 | K | PIC4 |
| Q | 10 | A | J | Q |
| PIC2 | 9 | 10 | PIC1 | J |
| K | SCAT | PIC3 | Q | PIC2 |
| J | J | K | 10 | K |
| SCAT | 10 | Q | SCAT | 9 |
| 9 | WILD | PIC1 | A | SCAT |
| Q | Q | 9 | J | A |
| PIC4 | K | Q | PIC2 | 10 |
| A | PIC2 | PIC2 | 10 | PIC4 |
| 10 | 9 | J | 9 | J |
| PIC3 | J | K | PIC1 | K |
| Q | PIC4 | PIC2 | A | PIC3 |
| 9 | 10 | 9 | Q | Q |
| PIC4 | K | Q | PIC2 | A |

811

FIGURE 8A

802

REEL SET B

| R1 | R2 | R3 | R4 | R5 |
|---|---|---|---|---|
| A | 9 | J | 10 | 9 |
| Q | K | A | K | 10 |
| PIC1 | SCAT | SCAT | WILD | PIC2 |
| 10 | Q | 10 | J | A |
| A | A | 9 | K | Q |
| PIC4 | PIC2 | PIC3 | PIC4 | PIC4 |
| Q | 9 | Q | Q | 10 |
| K | J | J | 10 | K |
| PIC3 | PIC4 | SCAT | PIC3 | PIC1 |
| 9 | 10 | K | 9 | J |
| PIC2 | PIC2 | PIC2 | PIC2 | PIC2 |
| PIC2 | PIC2 | PIC2 | PIC2 | PIC2 |
| PIC2 | PIC2 | PIC2 | PIC2 | PIC2 |
| PIC2 | PIC2 | PIC2 | PIC2 | PIC2 |
| PIC2 | PIC2 | PIC2 | PIC2 | PIC2 |
| PIC2 | PIC2 | PIC2 | PIC2 | PIC2 |
| PIC2 | PIC2 | PIC2 | PIC2 | PIC2 |
| PIC2 | PIC2 | PIC2 | PIC2 | PIC2 |
| 10 | PIC2 | PIC2 | 9 | PIC2 |
| PIC4 | Q | J | PIC4 | 10 |
| J | PIC3 | PIC4 | K | PIC4 |
| Q | 10 | A | J | Q |
| PIC2 | 9 | 10 | PIC1 | J |
| K | SCAT | PIC3 | Q | PIC2 |
| J | J | K | 10 | K |
| SCAT | 10 | Q | SCAT | 9 |
| 9 | WILD | PIC1 | A | SCAT |
| Q | Q | 9 | J | A |
| PIC4 | K | Q | PIC3 | 10 |
| A | PIC2 | PIC2 | 10 | PIC4 |
| 10 | 9 | J | 9 | J |
| PIC3 | J | K | PIC1 | K |
| Q | PIC4 | PIC2 | A | PIC3 |
| 9 | 10 | 9 | Q | Q |
| PIC4 | K | Q | PIC2 | A |

812

FIGURE 8B

803

REEL SET C

| R1 | R2 | R3 | R4 | R5 |
|---|---|---|---|---|
| A | 9 | J | 10 | 9 |
| Q | K | A | K | 10 |
| PIC1 | SCAT | SCAT | WILD | PIC2 |
| 10 | Q | 10 | J | A |
| A | A | 9 | K | Q |
| PIC4 | PIC2 | PIC3 | PIC4 | PIC4 |
| Q | 9 | Q | Q | 10 |
| K | J | J | 10 | K |
| PIC3 | PIC4 | SCAT | PIC3 | PIC1 |
| 9 | 10 | K | 9 | J |
| PIC3 | PIC3 | PIC3 | PIC3 | PIC3 |
| PIC3 | PIC3 | PIC3 | PIC3 | PIC3 |
| PIC3 | PIC3 | PIC3 | PIC3 | PIC3 |
| PIC3 | PIC3 | PIC3 | PIC3 | PIC3 |
| PIC3 | PIC3 | PIC3 | PIC3 | PIC3 |
| PIC3 | PIC3 | PIC3 | PIC3 | PIC3 |
| PIC3 | PIC3 | PIC3 | PIC3 | PIC3 |
| PIC3 | PIC3 | PIC3 | PIC3 | PIC3 |
| 10 | PIC3 | PIC3 | 9 | PIC3 |
| PIC4 | Q | J | PIC4 | 10 |
| J | PIC3 | PIC4 | K | PIC4 |
| Q | 10 | A | J | Q |
| PIC2 | 9 | 10 | PIC1 | J |
| K | SCAT | PIC3 | Q | PIC2 |
| J | J | K | 10 | K |
| SCAT | 10 | Q | SCAT | 9 |
| 9 | WILD | PIC1 | A | SCAT |
| Q | Q | 9 | J | A |
| PIC4 | K | Q | PIC3 | 10 |
| A | PIC2 | PIC2 | 10 | PIC4 |
| 10 | 9 | J | 9 | J |
| PIC3 | J | K | PIC1 | K |
| Q | PIC4 | PIC2 | A | PIC3 |
| 9 | 10 | 9 | Q | Q |
| PIC4 | K | Q | PIC2 | A |

813

FIGURE 8C

804

REEL SET D

| R1 | R2 | R3 | R4 | R5 |
|---|---|---|---|---|
| A | 9 | J | 10 | 9 |
| Q | K | A | K | 10 |
| PIC1 | SCAT | SCAT | WILD | PIC2 |
| 10 | Q | 10 | J | A |
| A | A | 9 | K | Q |
| PIC4 | PIC2 | PIC3 | PIC4 | PIC4 |
| Q | 9 | Q | Q | 10 |
| K | J | J | 10 | K |
| PIC3 | PIC4 | SCAT | PIC3 | PIC1 |
| 9 | 10 | K | 9 | J |
| PIC4 | PIC4 | PIC4 | PIC4 | PIC4 |
| PIC4 | PIC4 | PIC4 | PIC4 | PIC4 |
| PIC4 | PIC4 | PIC4 | PIC4 | PIC4 |
| PIC4 | PIC4 | PIC4 | PIC4 | PIC4 |
| PIC4 | PIC4 | PIC4 | PIC4 | PIC4 |
| PIC4 | PIC4 | PIC4 | PIC4 | PIC4 |
| PIC4 | PIC4 | PIC4 | PIC4 | PIC4 |
| PIC4 | PIC4 | PIC4 | PIC4 | PIC4 |
| 10 | PIC4 | PIC4 | 9 | PIC4 |
| PIC4 | Q | J | PIC4 | 10 |
| J | PIC3 | PIC4 | K | PIC4 |
| Q | 10 | A | J | Q |
| PIC2 | 9 | 10 | PIC1 | J |
| K | SCAT | PIC3 | Q | PIC2 |
| J | J | K | 10 | K |
| SCAT | 10 | Q | SCAT | 9 |
| 9 | WILD | PIC1 | A | SCAT |
| Q | Q | 9 | J | A |
| PIC4 | K | Q | PIC3 | 10 |
| A | PIC2 | PIC2 | 10 | PIC4 |
| 10 | 9 | J | 9 | J |
| PIC3 | J | K | PIC1 | K |
| Q | PIC4 | PIC2 | A | PIC3 |
| 9 | 10 | 9 | Q | Q |
| PIC4 | K | Q | PIC2 | A |

814

FIGURE 8D

METHOD OF GAMING, A GAMING SYSTEM AND A GAME CONTROLLER

CROSS-REFERENCE TO RELATED APPLICATIONS

This application is a continuation application of U.S. patent application Ser. No. 15/232,488 filed Aug. 9, 2016, entitled "METHOD OF GAMING, A GAMING SYSTEM AND A GAME CONTROLLER", which claims the benefit of priority to Australian Provisional Patent Application No. 2015903199, filed Aug. 10, 2015, the entire contents and disclosures of which are both hereby incorporated by reference in their entireties.

BACKGROUND

The present invention relates to a method of gaming, a gaming system and a game controller.

Gaming machines are known that include reel strips that have "stacks" of symbols (i.e. multiple instances of the same symbol at consecutive reel strip positions). In current gaming machines, the symbols that make up the stack are fixed A need exists for alternative gaming systems.

BRIEF DESCRIPTION

In one aspect, the invention provides a method of dynamically providing reel strips in an electronic gaming system is provided. The method is implemented using a gaming system. The gaming system includes a display configured to display a wagering game, a player input interface, a credit input mechanism and a game controller. The credit input mechanism includes at least one of a card reader, a ticket reader, a bill acceptor, and a coin input mechanism and is configured to establish a credit balance that is increasable and decreasable based on wagering activity. The method includes storing in a memory of the gaming system a plurality of reel strips sets, each reel strips set including a characteristic that is different from the other reel strips set. Further initiating a play of the game, selecting at random via the game controller, a reel strips set from the plurality of reel strips sets. The method also includes displaying, via the game controller, symbols in symbol display positions on the display of the gaming system. The method further includes evaluation, via the game controller, the selected symbols and updating via the game controller, a meter stored in the memory in accordance with the evaluation.

In another aspect, an electronic gaming system is provided. The electronic gaming system includes a display, a memory storing a plurality of reel strips sets, each reel strips sets including a characteristic which is different to the other sets of reel strips; and a game controller configured to initiate a play of the game, select, at random, a reel strips set from among the plurality of reel strips sets and display, selected symbols in symbol display positions on the display, evaluate the selected symbols; and to update a meter stored in the memory in accordance with the evaluation.

In yet another aspect, an electronic game controller for a gaming system is provided. The gaming system includes a display configured to display a wagering game, a player input interface, and a credit input mechanism. The credit input mechanism includes at least one of a card reader, a ticket reader, a bill acceptor and a coin input mechanism, and is configured to establish a credit balance that is increasable and decreasable based on wagering activity. The game controller includes a processor configured to receive an indication of a credit wager input to the credit input mechanism to initiate play of a base game. The game controller also includes a reel strip selector, configured to initiation a play of a game then select, at random, a reel strips set from a plurality of reel strips sets stored in a memory of the gaming system, wherein, each set of reel strips includes a characteristic that is different to the other sets of reel strips. A symbol selector configured to select symbols for display in the symbol display positions with the selected set of reel strips; and an outcome evaluator arranged to evaluate the selected symbols and update a meter stored in the memory in accordance with the evaluation.

BRIEF DESCRIPTION OF THE DRAWINGS

An exemplary embodiment of the invention will now be described with reference to the accompanying drawings in which:

FIG. 8A-8D illustrate exemplary reel strips of an exemplary game.

DETAILED DESCRIPTION

Figure 1:
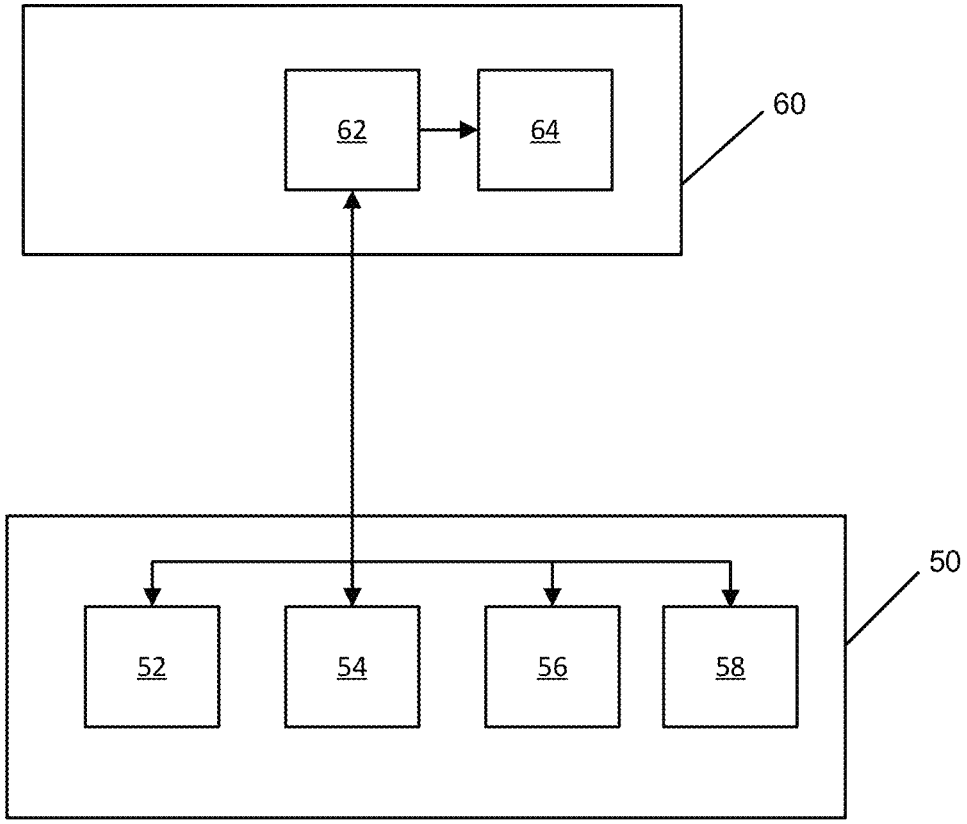
FIG. 1 is a block diagram of exemplary core components of a gaming system.

Referring to the drawings, there is shown a gaming system including a game controller. The game controller includes components that enable the implementation of a game wherein a reel strips set is randomly chosen by the game controller from a plurality of possible reel strips sets after play of the game is initiated but before symbols are selected. In one embodiment, weightings are assigned to each set of reel strips. In another embodiment, a player input may result in the weightings being adjusted by the game controller.

General Construction of an Exemplary Gaming System

The gaming system can take a number of different forms. In a first aspect, a standalone gaming machine is provided wherein all or most components required for implementing the game are present in a player operable gaming machine.

In a second aspect, a distributed architecture is provided wherein at least some of the components required for implementing the game are present in a player operable gaming machine and at least some of the components required for implementing the game are located remotely relative to the gaming machine. For example, a "thick client" architecture may be used wherein part of the game is executed on a player operable gaming machine and part of the game is executed remotely, such as by a gaming server. Alternatively, a "thin client" architecture may be used wherein most of the game is executed remotely from such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may selectively operate in standalone gaming machine mode, "thick client" mode or "thin client" mode depending on the game being played, operating conditions, and/or other factors. Other variations will be apparent to persons skilled in the art.

FIG. 1 is a block diagram of exemplary core components of a gaming system #, gaming system # includes several core components. At the broadest level, the exemplary core components are a player interface 50 and a game controller 60. Player interface 50 is configured to enable manual interaction between a player and the gaming system # and, as such, includes the input/output components required for the player to enter instructions to play the game and observe the game outcomes.

Components of player interface 50 may vary from embodiment to embodiment but will typically include at least a credit mechanism 52 to enable a player to input credits and to receive payouts, at least one display 54, a game play mechanism 56 including one or more input devices that enable a player to input game play instructions (e.g. to place a wager), and one or more speakers 58.

Game controller 60 is in data communication with the player interface 50 and typically includes a processor 62 that processes the game play instructions in accordance with game play rules and outputs game play outcomes to display 54. Typically, the game play rules are stored as program code in a memory 64 but can also be hardwired. Herein the term "processor" refers generically to any device that can process game play instructions in accordance with game play rules and may include. For example, a microprocessor, microcontroller, programmable logic device or other computational device, a general purpose computer (e.g. a PC) or a server. That is, a processor 62, may be provided by any suitable logic circuitry for receiving inputs, processing them in accordance with instructions stored in memory and generating outputs (for example on display 54). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
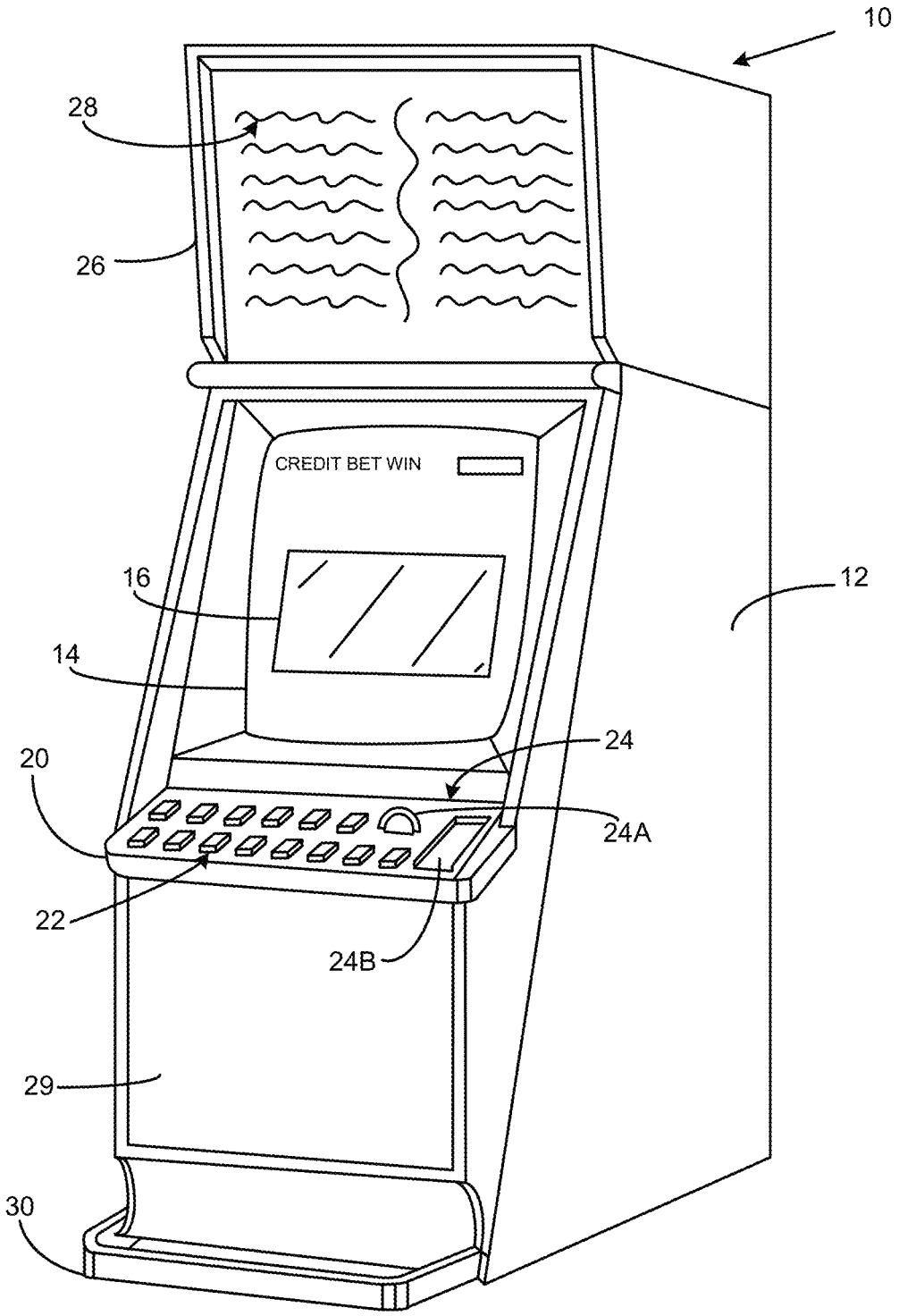
FIG. 2 is a perspective view of an exemplary standalone gaming machine.

FIG. 2 illustrates a gaming system 20 in the form of a standalone gaming machine 10. In the exemplary embodiment, gaming machine 10 includes a console 12 having a display 14 on which are displayed representations of a game 16 that can be played by a player. A mid-trim 20 of gaming machine 10 houses a bank of buttons 22 for enabling a player to interact with gaming machine, in particular during game play. Mid-trim 20 also houses a credit input mechanism 24. In the exemplary embodiment, credit input mechanism 24 includes a coin input chute 24A and a bill collector 24B. Other credit input mechanisms may also be employed, such as, for example, a card reader for reading a smart card, debit card, and/or credit card. Other gaming machines may be configured for ticket use, in that these gaming machines 10 include a ticket reader for reading tickets having a value and for crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module that is accessed in response to insertion of the player tracking device.

A top box 26 may carry artwork 28, including, for example, pay tables and details of bonus awards and other information or images relating to the game. Further artwork and/or information may be provided on a front panel 29 of console 12. A coin tray 30 is mounted beneath front panel 29 for dispensing cash payouts from gaming machine 10.

In the exemplary embodiment, display 14 is a liquid crystal display. Alternatively, display 14 may any other suitable video display unit, such as an OLED display. Top box 26 may also include a display, which may be of the same type as display 14, or of a different type.

Figure 3:
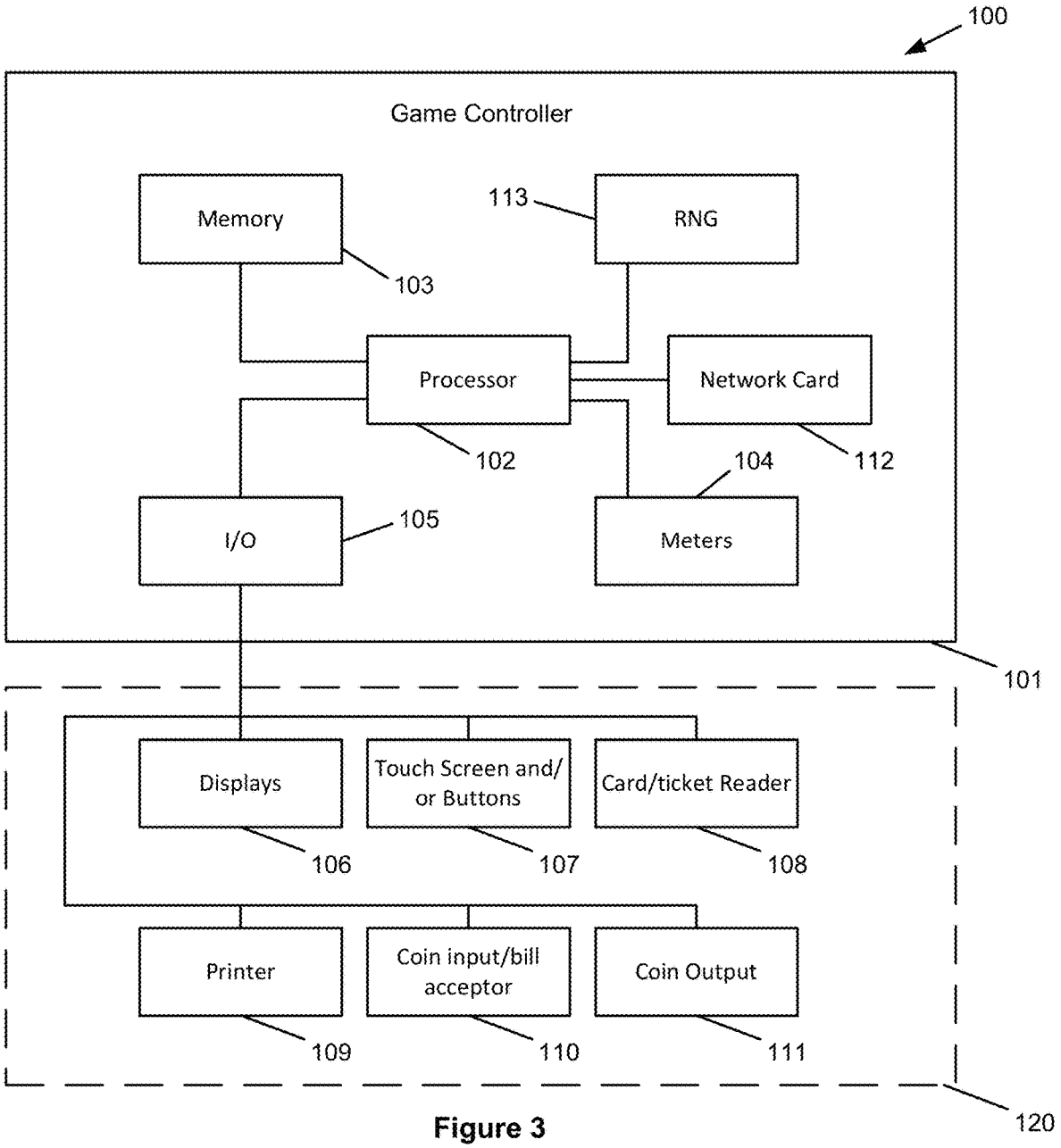
FIG. 3 is a block diagram of exemplary functional components of a gaming machine.

FIG. 3 illustrates a block diagram of exemplary functional components of a typical gaming machine which may be the same as or different to gaming machine 10 (shown in FIG. 2).

Gaming machine 100 includes a game controller 101 including a processor 102 mounted on a circuit board. Instructions and data to control operation of processor 102 are stored in a memory 103, that is in data communication with processor 102. Typically, gaming machine 100 will include both volatile and non-volatile memory and more than one of each type of memory, with such memories being collectively represented by the memory 103.

Gaming machine 100 includes hardware meters 104 for purposes including ensuring regulatory compliance and monitoring player credit, an input/output (I/O) interface 105 for communicating with peripheral devices of gaming machine 100. Input/output interface 105 and/or the peripheral devices may be intelligent devices with their own memory for storing associated instructions and data for use with the input/output interface or the peripheral devices. A random number generator module 113 generates random numbers for use by processor 102. Persons skilled in the art will appreciate that the reference to random numbers includes pseudo-random numbers.

In the exemplary embodiment, a player interface 120 includes peripheral devices that communicate with game controller 101 including one or more displays 106, a touch screen and/or input buttons 107 (which provide a game play mechanism), a card and/or ticket reader 108, a printer 109, a bill acceptor and/or coin input mechanism 110. The credit input mechanism is configured to receive a credit wager to initiate play of a base game, and establish a credit balance (e.g., using the received credit wager) that is increasable and decreasbale based on wagering activity within a game. Player interface 120 also includes a payout mechanism such as a printer 109 and/or a coin output mechanism 111. The payout mechanism is configured to output a pay out to a player of gaming machine 100 based on an outcome of the game (e.g., a base game and/or a future game). Additional hardware may be included as part of gaming machine 100, or hardware may be omitted as required for the specific implementation. For example, although buttons or touch screens are typically used in gaming machines to allow a player to place a wager and to initiate a play of a game any input device that enables the player to input game play instructions may be used. For example, in some gaming machines a mechanical handle may be used to initiate a play of the game. Persons skilled in the art will also appreciate that a touch screen can be used to emulate other input devices, such as, for example, a touch screen can display virtual buttons which a player can "press" by touching the screen where they are displayed.

In addition, gaming machine 100 may include a communications interface, for example a network card 112. Network card 112 may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of gaming machine 100.

Figure 4:
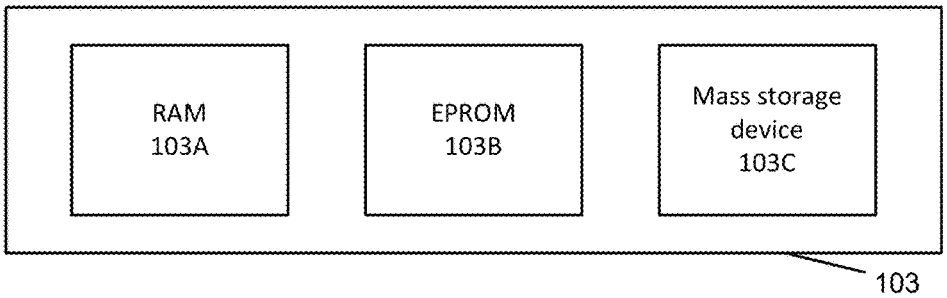
FIG. 4 is a schematic diagram of exemplary functional components of a memory.

FIG. 4 is a block diagram of the main components 115 of a memory 103. In the exemplary embodiment, memory 103 includes RAM 103A, EPROM 103B and a mass storage device 103C. RAM 103A typically temporarily holds program files for execution by the processor 102 and related data. EPROM 103B may be a boot ROM device and/or may contain some system or game related code. Mass storage device 103C is typically used to store game programs, the integrity of which may be verified and/or authenticated by processor 102 using protected code from EPROM 103B or elsewhere.

It is also possible for the operative components of gaming machine 100 to be distributed, for example input/output devices 106,107,108,109,110,111 are provided remotely from game controller 101.

Figure 5:
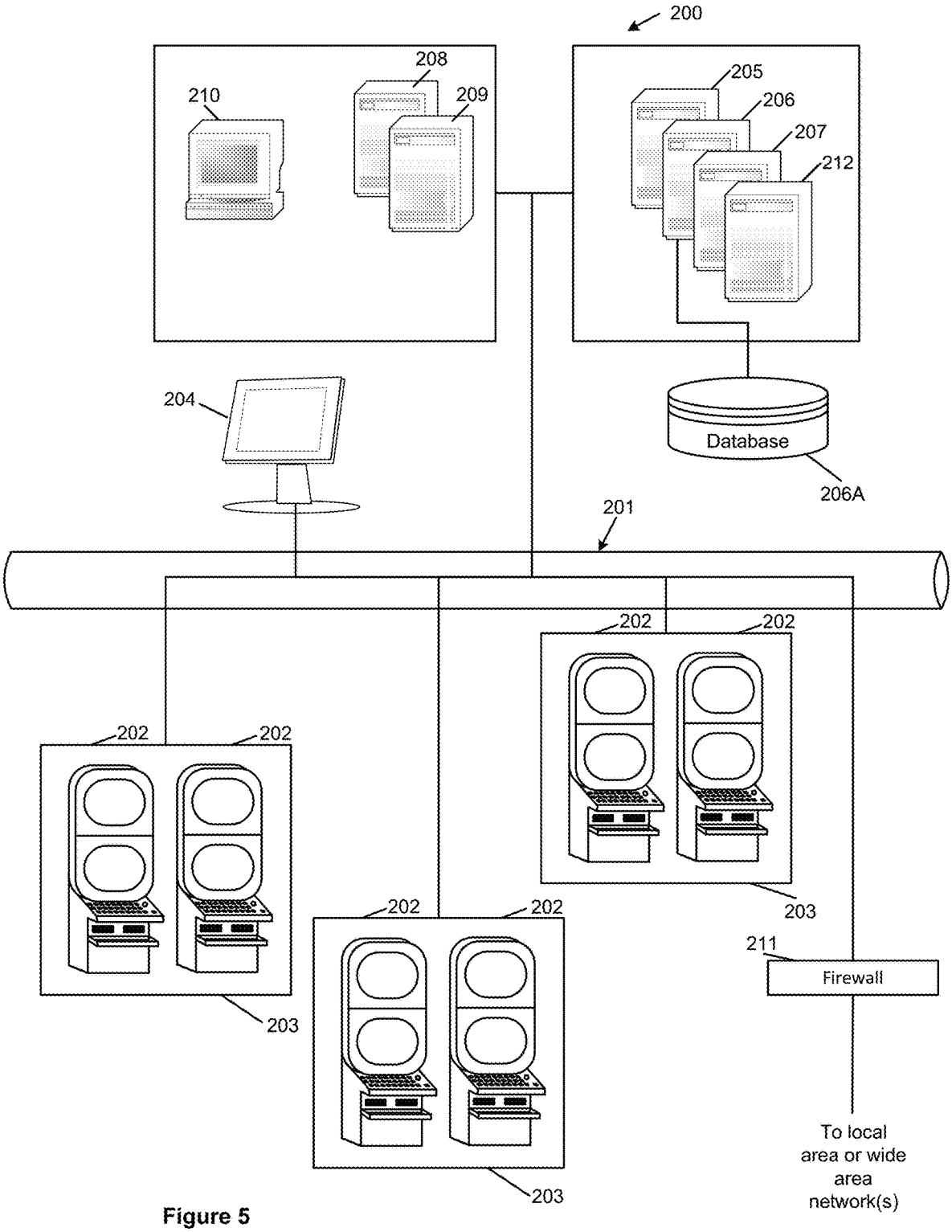
FIG. 5 is a schematic diagram of an exemplary network gaming system.

FIG. 5 illustrates an exemplary gaming system 200 in accordance with an alternative embodiment. Gaming system 200 includes a network 201, which for example may be an Ethernet network. In the exemplary embodiment, gaming machines 202, shown arranged in three banks 203 of two gaming machines 202, are coupled to network 201. Gaming machines 202 provide a player operable interface and may be the same as gaming machines 10 and/or 100 (shown respectively in FIGS. 2 and 3), or may have simplified functionality depending on the requirements for implementing game play. Although banks 203 of two gaming machines are shown in the exemplary embodiment, banks of one, three or more gaming machines 202 are also envisioned.

At least one display 204 may also be coupled to network 201. For example, displays 204 may be associated with at least one bank 203 of gaming machines 202. Displays 204 may be used to display representations associated with game play on gaming machines 202, and/or used to display other representations, for example promotional or informational material.

In a thick client embodiment, a game server 205 implements part of the game played by a player using a gaming machine 202 and gaming machine 202 implements part of the game. With this embodiment, as both the game server and the gaming machine 202 implement part of the game, they collectively provide a game controller. A database management server 206 may manage storage of game programs and associated data for downloading or access by the gaming devices 202 in a database 206A. Typically, if the gaming system 200 enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and gaming machine 202 essentially provides only the player interface. In such an embodiment, game server 205 provides the game controller and gaming machine 202 receives player instructions, and transmits these instructions to game server 205. Game server 205 processes the player instructions and returns game play outcomes to gaming machine 202 for display. In a thin client embodiment, such gaming machines 202 could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of gaming system 200, including for example a gaming floor management server 208, and a licensing server 209 to monitor the use of licenses relating to particular games. An administrator terminal 210 is provided to allow an administrator to run network 201 and the devices connected to network 201.

Gaming system 200 may communicate with other gaming systems, other local networks (for example a corporate network), and/or a wide area network such as the Internet, for example, through a firewall 211.

Persons skilled in the art will appreciate that in accordance with known techniques, functionality at the server side of network 201 may be distributed over a plurality of different computers. For example, elements may be run as a single "engine" on one server or a separate server may be provided. For example, game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Details of the Exemplary Gaming System

In one embodiment, the player operates game play mechanism 56 to specify a wager that may be evaluated for this play of the game and initiates a play of the game. Persons skilled in the art will appreciate that a player's wager can be varied from game to game dependent on player selections. In most spinning reel games, it is typical for the player's wager to include a selection as to how the game outcome will be evaluated by specifying what parts of the game outcome will qualify for winning outcomes. The player's wager may also include a multiplier that will apply to each winning outcome. For example, a player's wager may be based on how many lines they play in each game—e.g. a minimum of one line up to a maximum number of lines permitted by the game (noting that not all permutations of win lines may be available for selection) and an amount per line—e.g., one, two, or five credits. Winning outcomes on an activated win line may be evaluated based on a pay table that specifies the amount awarded for a one credit per line wager multiplied by the amount wagered per line.

Such win lines are typically defined by a combination of symbol display positions, one from each reel, the symbol display positions located relative to one another such that they form a line that extends across the reel.

In many games, gaming machine 200 may award winning outcomes that are not strictly limited to the lines they have selected. For example, "scatter" pays are awarded independently of a player's selection of pay lines.

Persons skilled in the art will appreciate that in other embodiments, the player may select a number of reels to play and an amount to wager. Games of this type are marketed under the trade name "Reel Power" by Aristocrat Leisure Industries Pty Ltd and are also known as "ways" to win games. The selection of a reel means that each displayed symbol of the reel can be substituted for another symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row may be used for non-selected reels. As a result, the total number of ways to win is determined by multiplying the number of active display positions of each reels, (the active display positions being all display positions of each selected reel) and the designated display position of the non-selected reels. As a result for five reels and fifteen display positions there are 243 possible ways to win.

In the embodiment described above, the display positions of the symbol display may be arranged in a rectangular matrix comprising a plurality of columns and a plurality of rows. However, in other embodiments other arrangements are known in the gaming industry and could be employed. For example, in some arrangements there may be more symbols in some columns than others, such as 3-4-3-4-3 arrangement of seventeen display positions corresponding to respective ones of five reels. In such arrangements, the columns of four symbols can be arranged so that they are off-set or staggered relative to the columns having three symbols in the middle two symbols in the columns of four symbols share boundaries with two symbols of each neighbouring reel.

Figure 6:
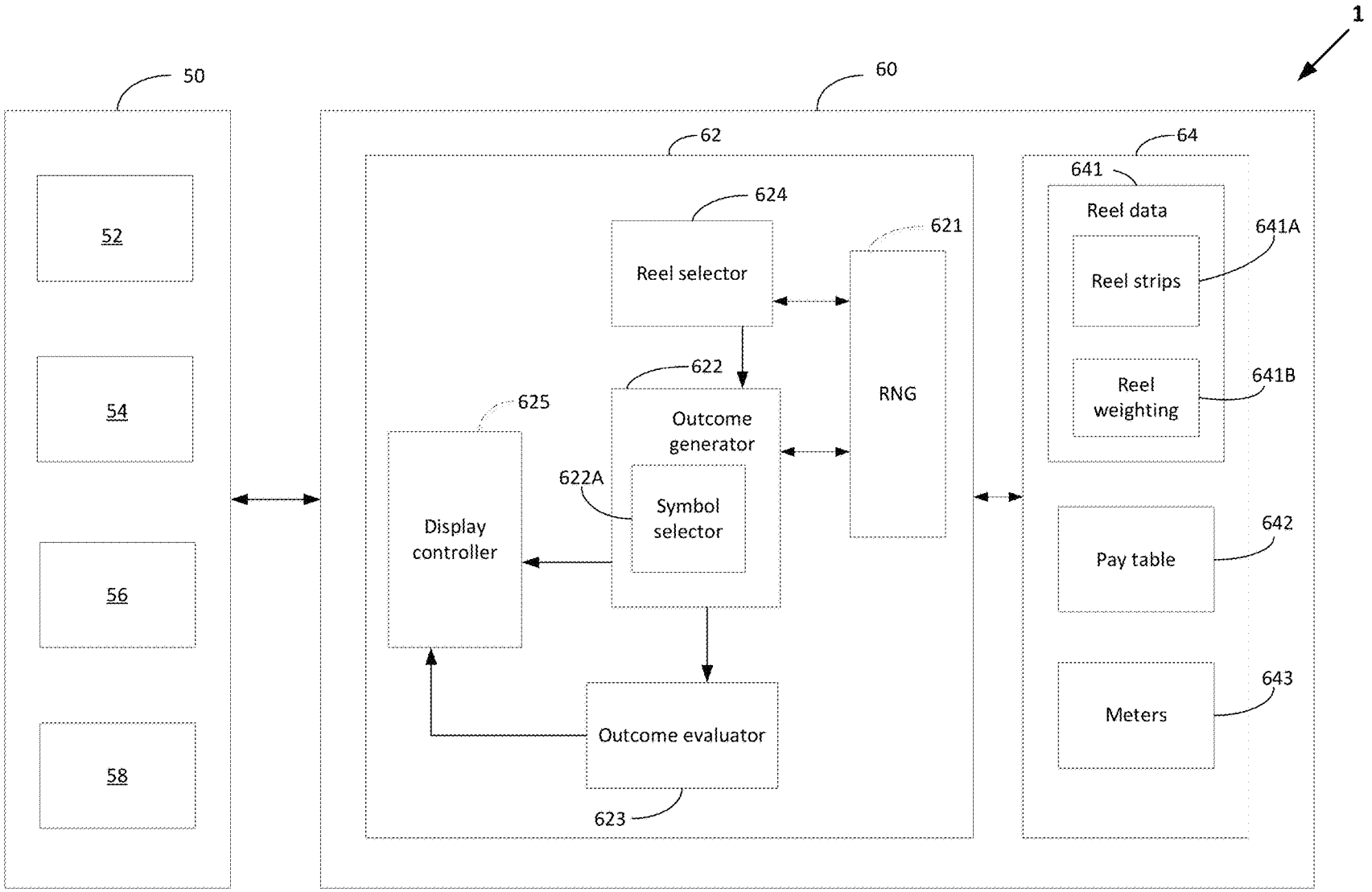
FIG. 6 is a further block diagram of an exemplary gaming system.

FIG. 6 illustrates another block diagram of an exemplary gaming system. In the exemplary embodiment, the processor 62 of game controller 60 is shown implementing a number of modules based on program code and data stored in memory 64. Persons skilled in the art will appreciate that various of the modules could be implemented in some other way. For example by a dedicated circuit.

Shown in the example embodiment the components of the gaming machine are used to update the reel strips in a base game. Memory 64 of gaming system 1 has reel data 641 which defines a number of reel strips sets 641A and weightings 641B associated with their relative probability of being selected.

In response to the initiation of play of a game, before the reels are used to select symbols, the reel selector 624 uses the reel weightings 641B assigned to specific reel strips 641A together with a value obtained from random number generator 621 in order to select the set of reel strips 641A of the plurality of sets of reel strips stored in memory 64 to be used in play of a game.

In some embodiments, the game controller may adjust the reel weightings 641B based on a player input such as an amount wagered or a volatility selection made by the player.

In one embodiment, reel weighting data 641B specifies a plurality of different sets of reel weightings and the reel selector 624 accesses the set or reel weightings for the present game based on the received wager or the received volatility request. For example, in one embodiment different reel weightings sets are stored in the reel data 641 in association with different ones of a plurality of possible wagers.

In one embodiment, the characteristic that makes the reel strips sets different is that they each include different groups of stacked symbols as shown in the example described below in relation to FIG. 8. In another example, each of the reel strips has a different characteristic in the form of different volatilities.

In another embodiment, the different reel strips sets includes a different characteristic in the form of different probabilities of delivering win outcomes. In one example, higher rated reel strips sets have a higher probability of delivering winning outcomes either in terms of frequency of wins and/or value of winning outcomes.

In the exemplary embodiment, once the reels strips are selected, the symbol selector 622A selects symbols for display at symbol display positions from the dynamically selected reel strips. As will be appreciated from the above discussion, the selected reel strips specify a sequence of symbols for each reel. In one embodiment, the symbol selector 622A selects the symbols for display by selecting a stopping position in the sequence. In another embodiment, three symbols of each of five reels are displayed such that symbols are displayed at fifteen symbol display positions on display 54. It is known to use a probability table stored in memory 64 to vary the odds of a particular stop position being selected. Other techniques can be used to control the odds of particular outcomes occurring to thereby control the return to player of the game.

Once the symbols are selected, they are evaluated by the outcome evaluator 623 by comparing the symbol selected at symbol display positions on display 54 with pay table 643. Both the selected symbols and any winning outcomes may be displayed on display 54 via display controller 625. Any wins are added to a win meter of meters 643 stored in memory 64. Assuming this ends that game, e.g. a feature is not triggered or the player does not chose a gamble feature, the value on the win meter can be transferred to the credit meter either by the player initiating a new play of the game or electing to cash out. In some embodiments, certain win types (e.g. jackpot prize wins) may be added directly to the credit meter.

While the above embodiment has been described an exemplary embodiment that implements dynamic stacks (where each of the reel strip sets are identical except for the stacked symbol, and a weighted table is used to select the reel strip set to be used for each spin, in other embodiments the symbols on the strips of each reel set may be completely different (for example different length stacks, different symbol patterns).

This has several applications including enabling the implementation of games where the quantum of a players wager affects the reels strips—a higher wager will increase the chance that a "higher" rated reel set will be selected for play (e.g. higher frequency of wins, higher value of wins, or both). Further enabling the control of volatility—the appropriate reel set will be chosen based on the player's preference (higher value wins less frequently or lower value wins more frequently).

One advantage is that the gaming system can simplify compliance work by allowing different reel strip sets to be deployed in different combinations to produce different RTPs, as appropriate for different jurisdictions.

As indicated above, the probability of selecting certain reel strips can be controlled by adjusting the individual weightings of the weighting table. On other embodiments the game controller may be configured to dynamically adjust the individual weightings based on a targeted overall weighting (for example driven by desired RTP or volatility).

In some embodiments, an eligibility criteria may be applied in order for the player to be eligible for the dynamic reel strips. For example that the player has made a certain sized wager, made an ante bet, selected all win lines, played sufficient games, or the player is a member of a loyalty program.

A play of a game may result in one or more wins. Typically, a win will result in some form of award being made such as an award of credits added to the win meter. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits that exist because the player has input cash or the like and credits resulting from an award.

Figure 7:
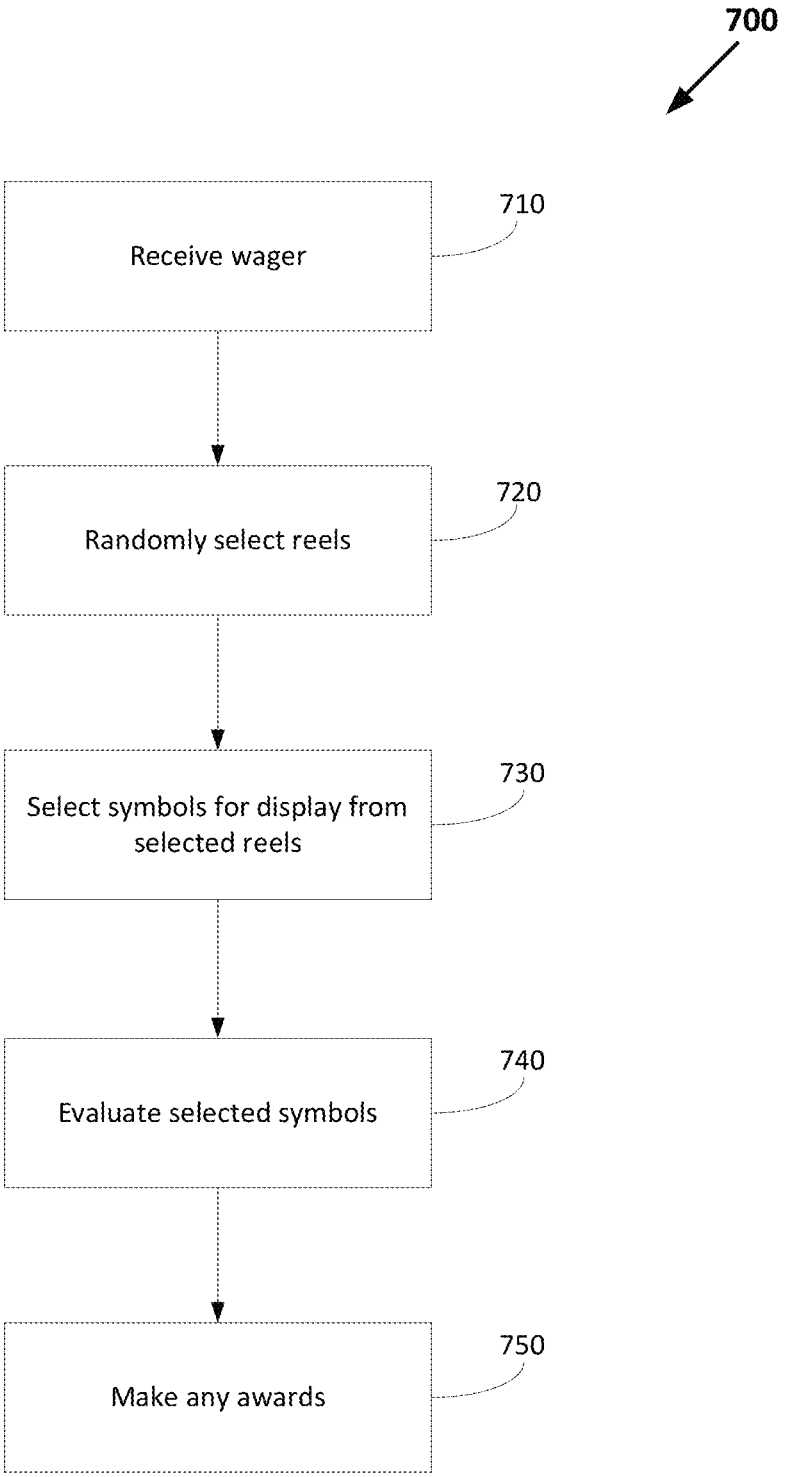
FIG. 7 is a flow chart of an exemplary method of electronic gaming.

FIG. 7 is a flow chart of an exemplary method 700. In the exemplary embodiment, method 700 includes receiving 710 a wager, randomly selecting 720 a set of reel strips, selecting 730 symbols using the selected reel strips, evaluating 7# the selected symbols, and making any awards by updating 750 a meter (typically a win meter but in some instances, a credit meter may be updated directly.)

Further aspects of the method will be apparent from the above description of the system. It will be appreciated that at least part of the method will be implemented electronically For example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

FIGS. 8A to 8D show four reel strips sets 801, 802, 803, 804. Each set of reel strips 801, 802, 803, 804 includes five reels R1, R2, R3, R4 and R5. Each reel strips set includes has a stack of symbols 811, 812, 813, 814.

FIG. 8A, shows that reel strip set A 801 has a stack 811 of "PIC1" symbols. FIG. 8B, reel strip set B 802 includes a stack 812 of "PIC2" symbols. FIG. 8C, reel strip set C 803 includes a stack 813 of "PIC3" symbols. FIG. 8D, reel set D includes a stack 814 of "PIC4" symbols.

A weighting table defines the relative probabilities of selecting the reel strip sets. Reel strip set A 801, includes a weighting of 1. Reel strip set B 802, has a weighting of 2. Reel set C 803, has a weighting of 3. Reel set D 804, has a weighting of 4. Accordingly, it is more likely that reel set D 804 will be selected than any of the other reel sets 801, 802 and 803.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the disclosure, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. An electronic gaming system comprising:

a display;

a credit input mechanism;

a memory storing a plurality of reel strip sets, each reel strip set of the plurality of reel strip sets including a unique characteristic including a reel weighting and a relative volatility of each reel strip included in each reel strip set; and a game controller executing instructions stored in the memory, which cause the game controller to:

receive a volatility selection from a player;

determine that a player eligibility criteria has been met for selecting a reel strip set from the plurality of reel strip sets, wherein the player eligibility criteria includes an input value submitted by the player;

select the reel strip set from the plurality of reel strip sets, the reel strip set selected dependent on a reel weighting associated with the reel strip set and the volatility selection;

select symbols from the selected reel strip set;

determine whether the selected symbols comprise an award; and cause the symbols to be displayed in symbol display positions on the display.

2. The system as claimed in claim 1, wherein the instructions further cause the game controller to adjust a relative probability of each reel strip set being selected based at least on the volatility selection and the reel weighting of each reel strip set.

3. The system as claimed in claim 1, wherein the instructions further cause the game controller to:

determine that the player eligibility criteria has been met for selecting the reel strip set from the plurality of reel strip sets, wherein the player eligibility criteria includes a threshold wager amount received from the player;

evaluate the symbols for a winning outcome;

update a meter stored in the memory in accordance with the evaluation; and present the winning outcome at the display.

4. The system as claimed in claim 1, wherein the unique characteristic further includes a group of stacked symbols that is different from groups of stacked symbols of corresponding reels in other reel strip sets of the plurality of reel strip sets.

5. The system as claimed in claim 1, wherein the unique characteristic further includes a rating assigned to each reel strip set associated with a probability of achieving a winning outcome from the reel strip set such that some reel strip sets are higher rated than other reel strip sets, wherein the instructions further cause the game controller to receive a wager and adjusting a relative probability of each reel strip set selected based on an amount of the wager and the ratings.

6. The system as claimed in claim 5, wherein higher rated reel strip sets have a relatively higher frequency of winning outcomes.

7. The system as claimed in claim 5, wherein winning outcomes for higher rated reel strip sets have a relatively higher value.

8. A method of dynamically providing reel strips in an electronic gaming system, the gaming system including a display configured to display a wagering game, a player input interface, a credit input mechanism including at least one of a card reader, a ticket reader, a bill acceptor, and a coin input mechanism configured to establish a credit balance that is increasable and decreasable based on wagering activity, and a game controller, said method comprising:

storing in a memory of the gaming system a plurality of reel strip sets, each reel strip set of the plurality of reel strip sets including a unique characteristic including a reel weighting associated with a relative probability of each reel strip set being selected, a reel rating associated with a probability of achieving a winning outcome from each reel strip set such that some reel strip sets are higher rated than other reel strip sets, and a relative volatility of each reel strip included in each reel strip set;

receiving at least one input including a volatility selection;

selecting, via the game controller, a reel strip set from the plurality of reel strip sets, the reel strip set selected dependent on the reel weighting associated with the reel strip set and the volatility selection, wherein the reel weighting is calculated based at least on the reel rating assigned to the reel strip set;

selecting symbols from the selected reel strip set;

determining whether the selected symbols comprise an award; and displaying the symbols in symbol display positions on the display of the gaming system.

9. The method as claimed in claim 8 further comprising adjusting a relative probability of each reel strip set being selected based at least on the volatility selection and the reel weighting of each reel strip set.

10. The method as claimed in claim 8 further comprising:

evaluating, via the game controller, the symbols for a winning outcome;

updating, via the game controller, a meter stored in the memory in accordance with the evaluating; and presenting the winning outcome.

11. The method as claimed in claim 8, wherein the unique characteristic further includes a group of stacked symbols that is different from groups of stacked symbols of corresponding reels in other reel strip sets of the plurality of reel strip sets.

12. The method as claimed in claim 8, wherein said method further comprises receiving a wager and adjusting a relative probability of each reel strip set selected based on an amount of the wager and the ratings.

13. The method as claimed in claim 12, wherein higher rated reel strip sets have a relatively higher frequency of winning outcomes.

14. A non-transitory computer-readable storage media for dynamically providing reel strips in an electronic gaming system, the non-transitory computer-readable storage media having computer-executable instructions embodied thereon, wherein, when executed by at least one processor, the computer-executable instructions cause the processor to:

store in a memory of the gaming system a plurality of reel strip sets, each reel strip set of the plurality of reel strip sets including a unique characteristic comprising a reel weighting and a relative volatility of each reel strip included in each reel strip set;

receive an input comprising a volatility selection;

determine that a player eligibility criteria has been met for selecting a reel strip set from the plurality of reel strip sets, wherein the player eligibility criteria includes an input value submitted by the player;

select a reel strip set from the plurality of reel strip sets, the reel strip set selected dependent on the reel weighting associated with the reel strip set and the volatility selection;

select symbols from the selected reel strip set;

determine whether the selected symbols comprise an award; and cause the symbols to be displayed in symbol display positions on a display of the gaming system.

15. The non-transitory computer-readable storage media as claimed in claim 14, wherein the computer-executable instructions further cause the processor to adjust a relative probability of each reel strip set being selected based at least on the volatility selection and the reel weighting of each reel strip set.

16. The non-transitory computer-readable storage media as claimed in claim 14, wherein the computer-executable instructions further cause the processor to:

determine that the player eligibility criteria has been met for selecting the reel strip set from the plurality of reel strip sets, wherein the player eligibility criteria includes a threshold wager amount received from the player;

evaluate the symbols for a winning outcome;

update a meter stored in the memory in accordance with the evaluation; and present the winning outcome.

17. The non-transitory computer-readable storage media as claimed in claim 14, wherein the unique characteristic further comprises a group of stacked symbols that is different from groups of stacked symbols of corresponding reels in other reel strip sets.

18. The non-transitory computer-readable storage media as claimed in claim 14, wherein the unique characteristic further comprises a rating assigned to each reel strip set associated with a prospect of achieving a winning outcome from the reel strip set such that some reel strip sets are higher rated than other reel sets, wherein the computer-executable instructions cause the processor to receive a wager and adjust a relative probability of each reel strip set being selected based on an amount of the wager and the ratings.

19. The non-transitory computer-readable storage media as claimed in claim 18, wherein higher rated reel strip sets have a relatively higher frequency of winning outcomes.

20. The non-transitory computer-readable storage media as claimed in claim 18, wherein winning outcomes for higher rated reel strip sets have a relatively higher value.

* * * * *